US007758040B2

(12) United States Patent
Hashimoto et al.

(10) Patent No.: US 7,758,040 B2
(45) Date of Patent: Jul. 20, 2010

(54) SHEET FEED CASSETTE AND IMAGE FORMING APPARATUS USING THE SAME

(75) Inventors: Haruo Hashimoto, Ibaraki (JP); Takamitsu Ikematsu, Ibaraki (JP); Kazuhiro Wakamatsu, Ibaraki (JP); Kouichi Oomori, Ibaraki (JP); Tadashi Okano, Ibaraki (JP); Akio Miyauchi, Ibaraki (JP); Katsumi Kumada, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/003,463

(22) Filed: Dec. 26, 2007

(65) Prior Publication Data

US 2008/0179818 A1 Jul. 31, 2008

(30) Foreign Application Priority Data

Dec. 27, 2006 (JP) ..... P2006-351610

(51) Int. Cl.
*B65H 1/00* (2006.01)

(52) U.S. Cl. ..... 271/145; 271/171

(58) Field of Classification Search ..... 271/171, 271/145

See application file for complete search history.

(56) References Cited

U.S. PATENT DOCUMENTS

| | | | | | |
|---|---|---|---|---|---|
| 5,172,903 | A * | 12/1992 | Haneda et al. | ..... | 271/171 |
| 5,537,195 | A * | 7/1996 | Sagara et al. | ..... | 399/381 |
| 6,769,681 | B2 * | 8/2004 | Nakamura et al. | ..... | 271/171 |
| 2003/0047864 | A1 * | 3/2003 | Nakamura et al. | ..... | 271/162 |

FOREIGN PATENT DOCUMENTS

| | | | |
|---|---|---|---|
| JP | 5-97257 | | 4/1993 |
| JP | 5-294540 | * | 11/1993 |
| JP | 6-48590 | * | 2/1994 |
| JP | 6-144598 | * | 5/1994 |
| JP | 9-110184 | | 4/1997 |
| JP | 11-278685 | | 10/1999 |
| JP | 2003-118853 | * | 4/2003 |
| JP | 2004-224507 | | 8/2004 |

* cited by examiner

*Primary Examiner*—Patrick Mackey
*Assistant Examiner*—Thomas A Morrison
(74) *Attorney, Agent, or Firm*—McGinn IP Law Group, PLLC

(57) ABSTRACT

According to an aspect of the present invention, there is provided a sheet feed cassette including: a main container on which sheets are mounted; a sub container slidably attached to the main container; and first slidable portions that are arranged on sidewalls of each of the main container and the sub container, and that are formed in a U-shape.

17 Claims, 14 Drawing Sheets

SHEET FEED CASSETTE AND IMAGE FORMING APPARATUS USING THE SAME

CROSS-REFERENCE TO RELATED APPLICATIONS

The entire disclosure of Japanese Patent Application No. 2006-351610 filed on Dec. 27, 2006 including specification, claims, drawings and abstract is incorporated herein by reference in its entirety.

BACKGROUND OF THE INVENTION

1. Field of the Invention

An aspect of the present invention relates to a sheet feed cassette. More particularly, it relates to a sheet feed cassette capable of mounting sheets of a plurality of sizes, and an image forming apparatus using the same.

2. Description of the Related Art

In recent years, the reduction of size of an image forming apparatus has proceeded. Accordingly, a sheet feed cassette to be mounted in an image forming apparatus main body has been also reduced in size. However, the size of the sheet to be used remains unchanged. Therefore, according to a size reduction of the sheet feed cassette, the size of the mountable sheet is limited. Thus, there are proposed a system in which an exclusive sheet feed cassette for small size sheets, large size sheets, or the like is selected for each size of sheets to be used; a system in which the sheet feed cassette is made extractable to support from small size to large size sheets; and the like (e.g., see JP-A-9-110184).

Also, some of the sheet feed cassettes each projecting from an image forming apparatus main body include a top side cover attached thereon.

However, in the case of the system in which an exclusive sheet feed cassette is selected for each size of the sheets to be used, the sheet feed cassettes are required to be changed for every size of sheets. Therefore, the operation is troublesome. Further, a plurality of the sheet feed cassettes are required to be prepared, resulting in a correspondingly higher cost. In addition, additional space such as the storage site for the sheet feed cassettes not in use also becomes necessary. Thus, the operability is not good.

As compared with that, with the systems in which the sheet feed cassette is made extractable, one cassette can support sheets of a plurality of sizes. Therefore, the system is excellent in general versatility. However, there are many systems complicated in structure, systems unstable in positioning of sheets, or other systems.

For example, in JP-A-9-110184, an extractable sheet feed cassette includes a main container and a sub container. One side of the main container to be mounted in an image forming apparatus is formed in a double structure of a top plate and a bottom plate so as to have a space therebetween. And, the sub container is slidably inserted into the space between the top plate and the bottom plate. In the cassette, the main container is configured in a double structure for ensuring the rigidity. However, with such a configuration the structure is complicated, and further the cost also increases. Also, when the sub container is extracted or retracted, the reliability is poor because the locking mechanism for holding the sub container at a desirable position is formed of an elastic member formed on the sub container. Thus, a deviation tends to occur in the positional relationship between the main container and the sub container during attachment and detachment, or the like of the sheet feed cassette. As a result, a deviation occurs at the sheet feed position, and malfunctions, such as sheet feed jam and erroneous detection of the sheet size, occur. Thus, the operability is not good.

In the case of the extractable cassette, the top side cover is necessary when the cassette is extracted outside the image forming apparatus. However, it is not necessary when the cassette is retracted. Therefore, there has been a demand for the one which is easy to attach or detach, and is rotatable.

SUMMARY OF THE INVENTION

Under such circumstances, it is an object of this application to ensure the rigidity and the reliability of sheet size detection with a simple configuration in an extractable sheet feed cassette including a main container and a sub container. Further, it is another object to dispose a reliable locking unit of the sub container, and to ensure favorable attaching and detaching operability of the sheet feed cassette in order to prevent the extraction and retraction of the sub container due to the attachment and detachment of the sheet feed cassette.

According to an aspect of the present invention, there is provided a sheet feed cassette including: a main container on which sheets are mounted; a sub container slidably attached to the main container; and first slidable portions that are arranged on sidewalls of each of the main container and the sub container, and that are formed in a U-shape.

The sheet feed cassette may further includes: second slidable portions that are arranged on sheet mounting planes of the main container and the sub container, and that are formed in an L-shape.

The sheet feed cassette may further includes: a locking member that positions the sub container in a direction of an extraction and a retraction from the main container.

The locking member may be formed so as to be elastically deformable when attached into the main container.

The sheet feed cassette may further includes: a rear end guide that is arranged on the sub container, that regulates a rear end of the sheets, and that is slidable in a direction of an extraction and a retraction of the sub container from the main container; and a size detector that is coupled with the rear end guide, and that detects a size of the sheets.

The sheet feed cassette may further includes: a size detector arranged on bottom rear portions of the main container and the sub container; a main container bottom cover that is arranged on a bottom of the main container beneath the size detector; and a sub container bottom cover that is arranged on a bottom of the sub container beneath the size detector, and that slides with the sub container.

The sub container may include a grip for an extraction of the sheet feed cassette from an image forming apparatus.

The sheet feed cassette may further includes: a rotary axis that is arranged on left and right top sides of the sub container, and that rotatably supports a cover covering a top opening of the sub container.

According to another aspect of the present invention, there is provided an image forming apparatus including the sheet feed cassette.

The first slidable portions may be formed in an angular U-shape.

According to still another aspect of the present invention, there is provided a sheet feed cassette including: a main container including: a main bottom plane on which sheets are mounted, main sidewalls that are disposed on sides of the main bottom plane along a direction of an extraction and a retraction, main horizontal projections that outwardly project from upper portions of the main sidewalls in a horizontal direction parallel with the main bottom plane, and main vertical projections that downwardly project from end portions of the main horizontal projections in a vertical direction orthogonal to the horizontal direction; and a sub container slidably attached to the main container, the sub container including: a sub bottom plane that is arranged so as to be parallel with the main bottom plane, sub sidewalls that are disposed on sides of the sub bottom plane along the direction of an extraction and a retraction, sub horizontal projections that outwardly project from upper portions of the sub sidewalls in the horizontal direction, and sub vertical projections that downwardly project from end of the sub horizontal projections in the vertical direction.

BRIEF DESCRIPTION OF THE DRAWINGS

Embodiments of the present invention will be described in detail based on the following figures, wherein.

DETAILED DESCRIPTION OF THE INVENTION

Best Mode for Carrying Out the Invention

In order to ensure the rigidity of the sheet feed cassette, and ensure the reliability of the sheet size detection and the attaching and detaching operability, on each of the opposite sides of both of the main container and the sub container, a U-shaped first sliding part is formed. Further, on each sheet mounting side of the main container and the sub container, a second sliding part formed in an L-shape is formed. Furthermore, a locking unit that positions the sub container is disposed.

In other words, a sheet feed cassette includes a main container that is mounted into an image forming apparatus main body, and a sub container extractably in the direction of sheet transport with respect to the main container. In the main container and the sub container, U-shaped first slidable parts are formed respectively on the opposite sidewall sides orthogonal to the direction of sheet transport. Thus, the deviation in position in the lateral direction (the direction orthogonal to the direction of sheet transport) of the main container and the sub container is suppressed. Further, at the sheet mounting sides of the main container and the sub container, L-shaped second sliding parts are respectively formed in the direction of sheet transport. Thus, the deviation in position in the vertical direction of the main container and the sub container is suppressed.

Below, one embodiment will be described by reference to FIGS. 1 to 14.

Figure 14:
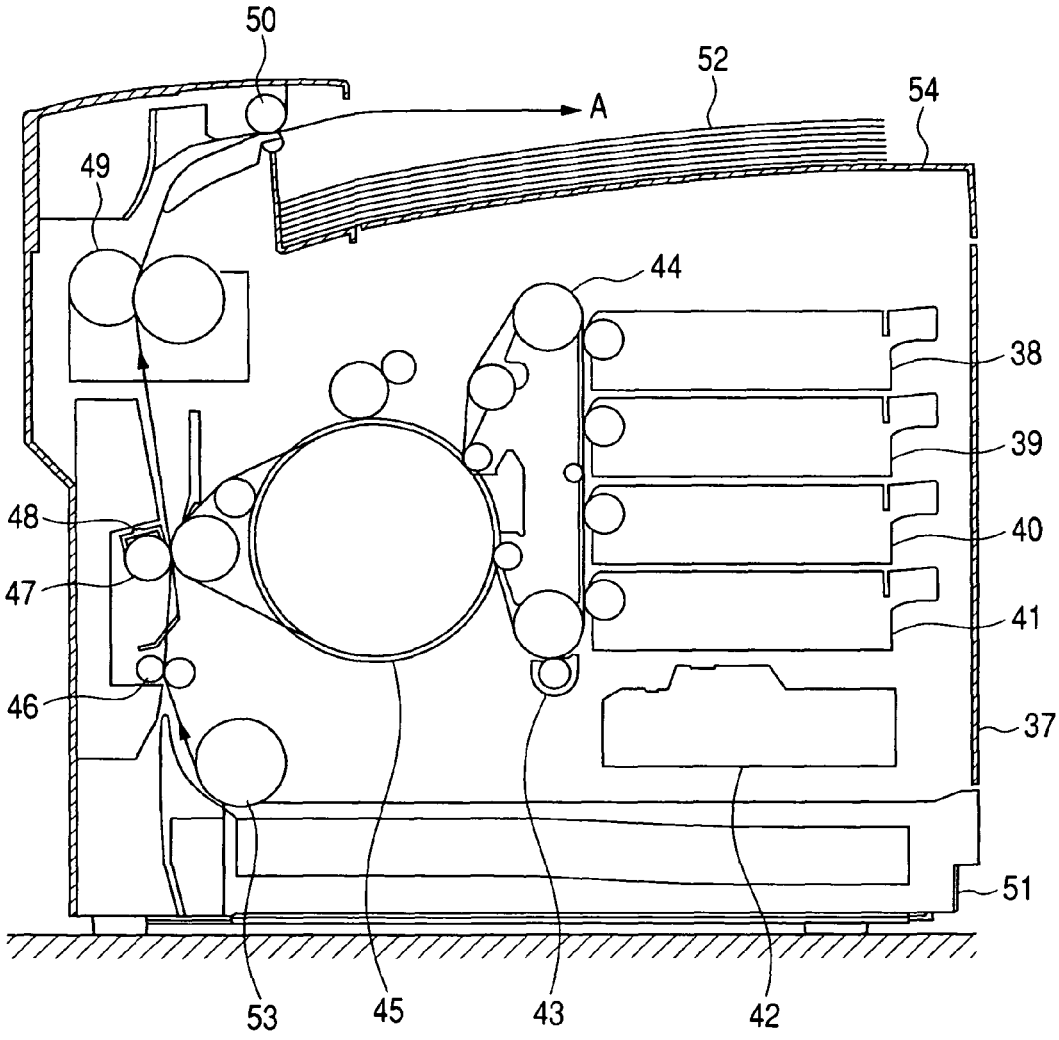
FIG. 14 is a cross sectional view of an image forming. apparatus according to one embodiment.

FIG. 14 shows a main cross section of an image forming apparatus including the sheet feed cassette according to the embodiment mounted therein. First, the configuration will be described. An image forming apparatus 37 includes developing units 38 to 41, an optical unit 42, a charging unit 43, a photosensitive belt 44, a transfer belt 45, a registration roller 46, a transfer roller 47, a charge eliminating unit 48, a fixing unit 49, a sheet output roller 50, and a sheet feed cassette 51 as main constituent components.

Then, the operation of the image forming apparatus 37 will be described. The charging unit 43 uniformly charges the photosensitive belt 44 by a printing start signal from a host (not shown). The optical unit 42 draws a latent image on the photosensitive belt 44 in response to the print data sent from the host. The drawn latent image is developed by one of the developing units 38 to 41, and toners in the developing units 38 to 41 are applied on the photosensitive belt 44. The photosensitive belt 44 rotates by a driving source (not shown), so that the toner on the photosensitive belt 44 is transferred on the transfer belt 45. In the case of color printing, this step is repeated 3 or 4 times while switching the developing units 38 to 41.

On the transfer belt 45, a visible image by monochrome or multicolor toners is formed. At the time of, or prior to completion of desirable transfer, a sheet 52 is drawn from the sheet feed cassette 51 by a sheet feed roller 53, and is allowed to wait at the registration roller 46. At the right timing at which the position of the visible image formed on the transfer belt 45 comes in alignment with the transfer position onto the sheet 52, the sheet 52 which has waited at the registration roller 46 starts to be transported again, so that the visible image is transferred to the sheet 52 side by the transfer roller 47. By the charge eliminating unit 48, the sheet 52 is peeled off from the transfer belt 45, and the toner is fixed on the sheet 52 by the fixing unit 49. The sheet 52 having an image formed thereon is discharged in the direction of an arrow A in the drawing by the sheet output roller 50, and is stacked in a sheet output tray 54.

Then, the mechanism of the sheet feed cassette 51 according to the embodiment will be described.

Figure 1:
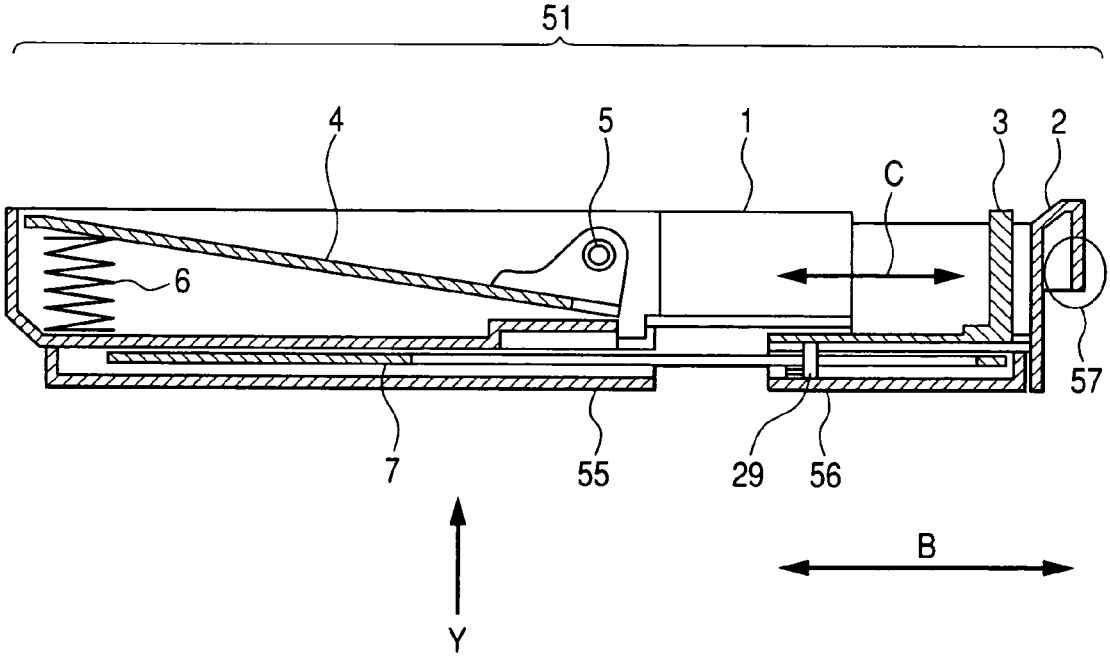
FIG. 1 is a cross sectional view of a sheet feed cassette according to one embodiment.

FIG. 1 shows a main cross section (lateral side direction) of the sheet feed cassette 51 according to the embodiment, and shows a state in which the sub container 2 is most drawn with respect to the main container 1.

The sub container 2 fits slidably in the direction of an arrow B in the drawing parallel with the direction of sheet transport with respect to the main container 1. The main container 1 has a base plate 4 for raising sheets with respect to the sheet feed roller 53 in FIG. 14. The base plate 4 is disposed so as to rotate about a rotary shaft 5 disposed in the main container as the center, and so as to be raised to a higher level than that of a spring 6.

Also, in the sub container 2, a grip part 57 for the attaching or detaching operation, and a sheet rear end guide 3 for regulating the rear end of each sheet are disposed. The sheet rear end guide 3 is slidable in the same direction of an arrow C as the direction of extraction and retraction of the sub container 7.

At the bottom rear parts of the main container 1 and the sub container 2, a sheet size detection unit 7 is disposed so as to move in a coupled manner with the sheet rear end guide 3. At a further lower parts than that of the bottom rear parts, a bottom side cover 55 of the main container 1 and a bottom side cover 56 of the sub container 2 are independently set for the main container 1 and the sub container 2, respectively. The bottom side cover 56 of the sub container 2 follows sliding of the sub container 2.

To the sheet rear end guide 3, a pin 29 fitting in the sheet size detection unit 7 is disposed, resulting in a mechanism in which the sheet size detection unit 7 moves in a coupled manner with the motion (arrow C) of the sheet rear end guide 3.

Figure 2:
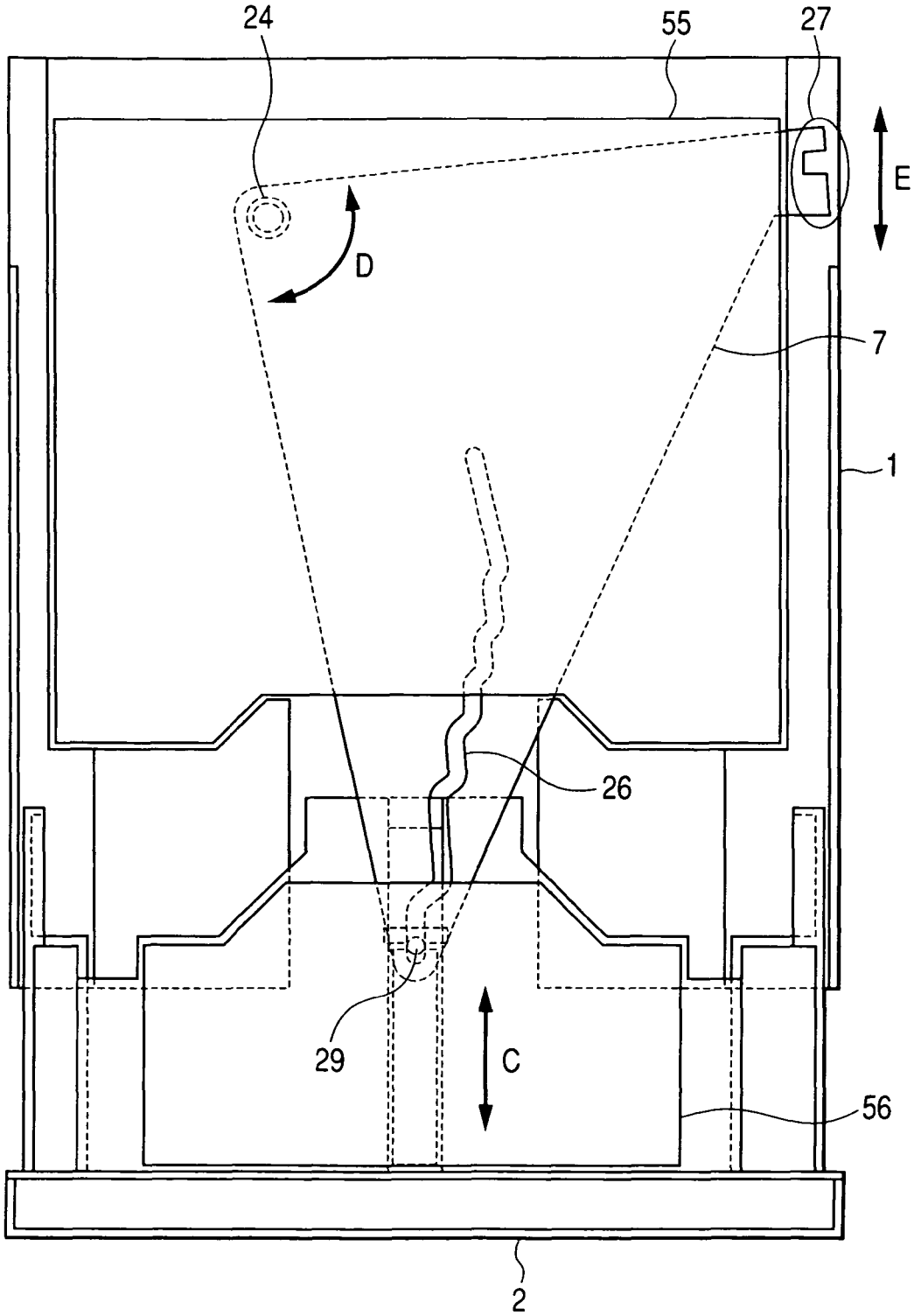
FIG. 2 is a bottom view of the sheet feed cassette according to one embodiment.
Figure 3:
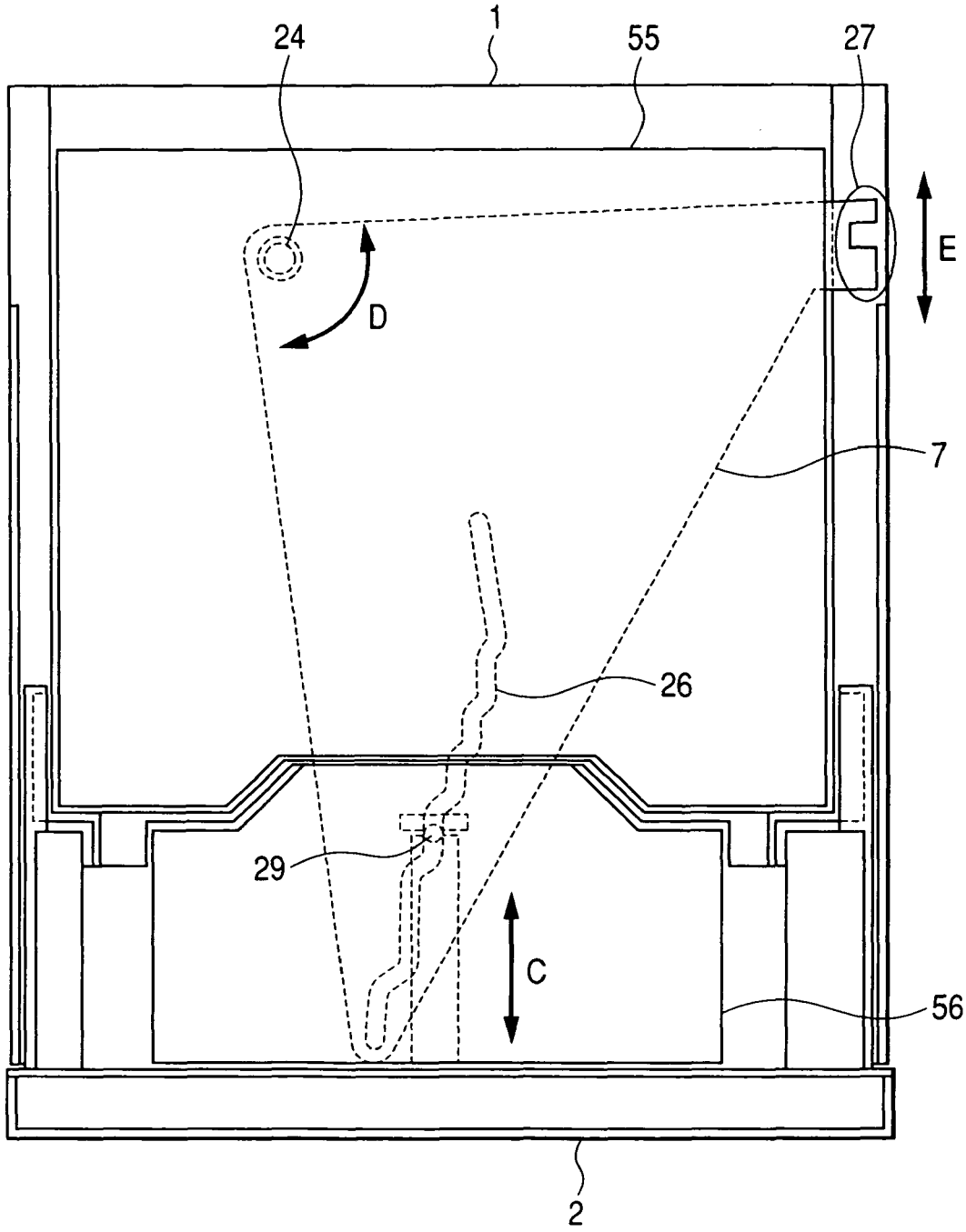
FIG. 3 is a bottom view of the sheet feed cassette according to one embodiment.

FIGS. 2 and 3 show the states of the sheet feed cassette according to the embodiment with the sub container 2 extracted and retracted, respectively, and each is a bottom view as seen from the Y direction of FIG. 1. Description for the constitution and the function of the sheet feed cassette shown in FIGS. 2 and 3 will be described by reference to FIGS. 10, 11, and 12 described later.

Figure 4:
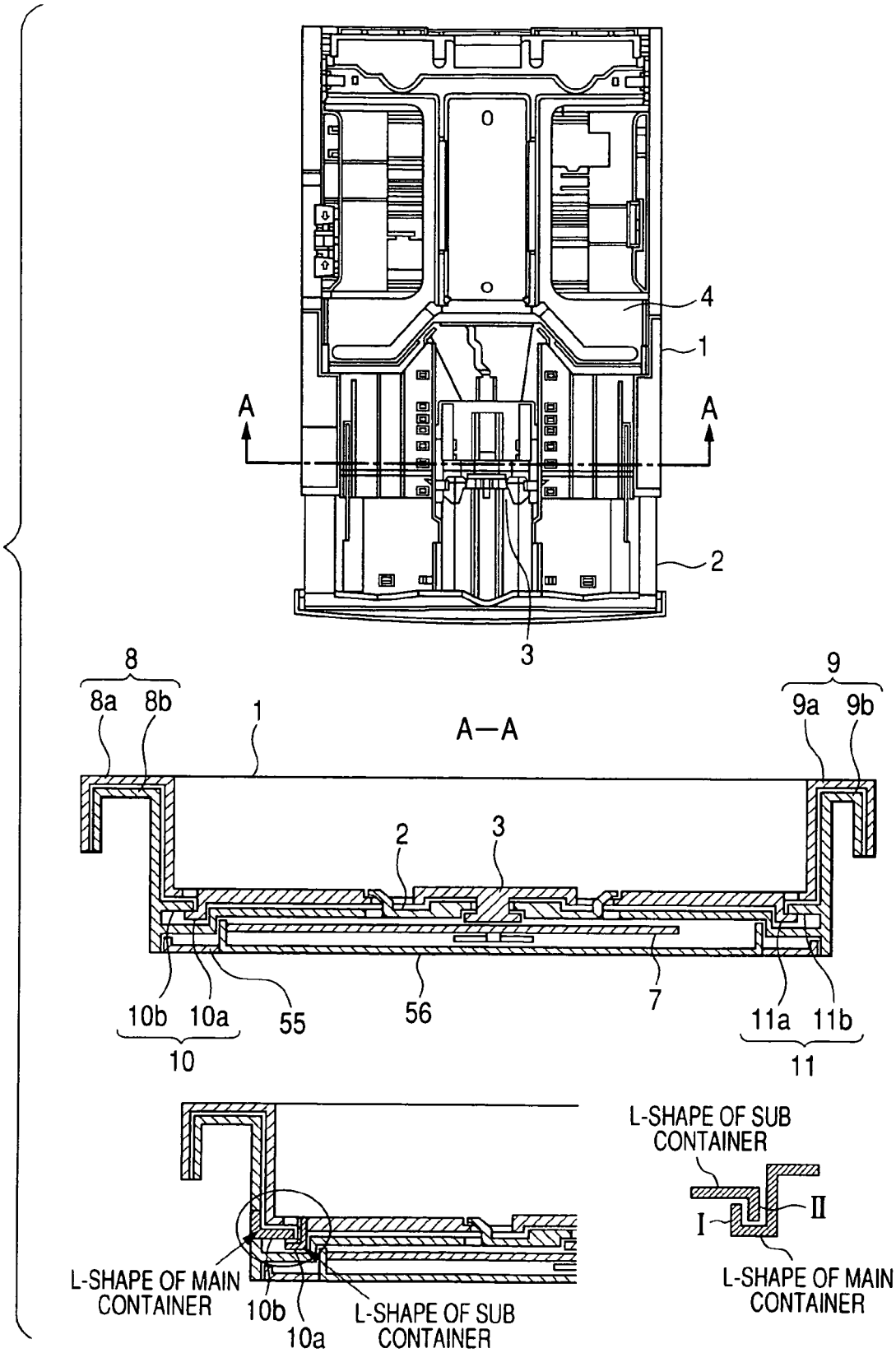
FIG. 4 is a cross sectional view of the sheet feed cassette according to one embodiment.

The lower view of FIG. 4 shows a cross section along A-A in the direction of front of the sheet feed cassette according to the embodiment. An embodiment will be described by reference to FIG. 4.

The upper parts of the left and right sidewalls of the main container 1 and the sub container 2 form U-shaped first sliding parts 8 and 9 including 8*a* and 9*a* of the main container 1, and 8*b* and 9*b* of the sub container 2, respectively. They suppress the positional deviation in the lateral direction of the sub container 2 with respect to the main container 1. The U-shape indicates three sides including the upper part in the direction horizontal to the sheet mounting side, and two sides in the direction vertical to the sheet mounting side, and indicates the shape having no bottom part. In addition to the main container 1, the shape of the side wall of the sub container 2 is also a U-shape. Therefore, the rigidity of the sub container 2 itself is ensured. As a result, it is possible to prevent the sub container 2 from being distorted or deformed when the sub container 2 is drawn. Further, the sub container 2 is not configured to be slidably inserted into the space in the tube-like inside including the top plate, the bottom plate, and side plates. Therefore, the configuration is not complicated, and an increase in cost is also not caused. If each of the first sliding parts is consists of only two sides (a vertical side upwardly extend from the end of the sheet mounting side and a horizontal side outwardly extend from the end of the vertical side), the rigidity is insufficient.

Further, the sheet mounting side leading from the left and right sidewalls to the bottom part forms L-shaped second sliding parts 10 and 11 including main container side sliding parts 10*a* and 11*a* leading from the sheet mounting side of the main container 1 toward the bottom roughly vertically, and respectively projecting in the directions of the left and right sidewalls in parallel with the sheet mounting side again, and sub container side sliding parts 10*b* and 11*b* projecting roughly perpendicularly to the direction of sliding with 10*a* and 11*a* from the U-shaped left and right sidewalls of the sub container 2, respectively. This configuration suppresses the deviation in position in the vertical direction of the sub container 2 with respect to the main container 1.

Alternatively, the main container side sliding parts 10*a* and 11*a* lead from the sheet mounting side of the main container 1 toward the bottom roughly vertically, and respectively projecting in the directions of the left and right sidewalls in parallel with the sheet mounting side again, and each may continuously have a rising part (I) roughly perpendicular to the direction of the sheet mounting side, disposed therein. In this case, there is also conceivable a configuration in which the sub container side sliding parts 10*b* and 11*b* respectively project from the U-shaped left and right sidewalls roughly vertically, and continuously have falling parts (II) leading in the direction of the bottom roughly vertically again, disposed therein, in order to slide with 10*a* and 11*b*, respectively.

Figure 5:
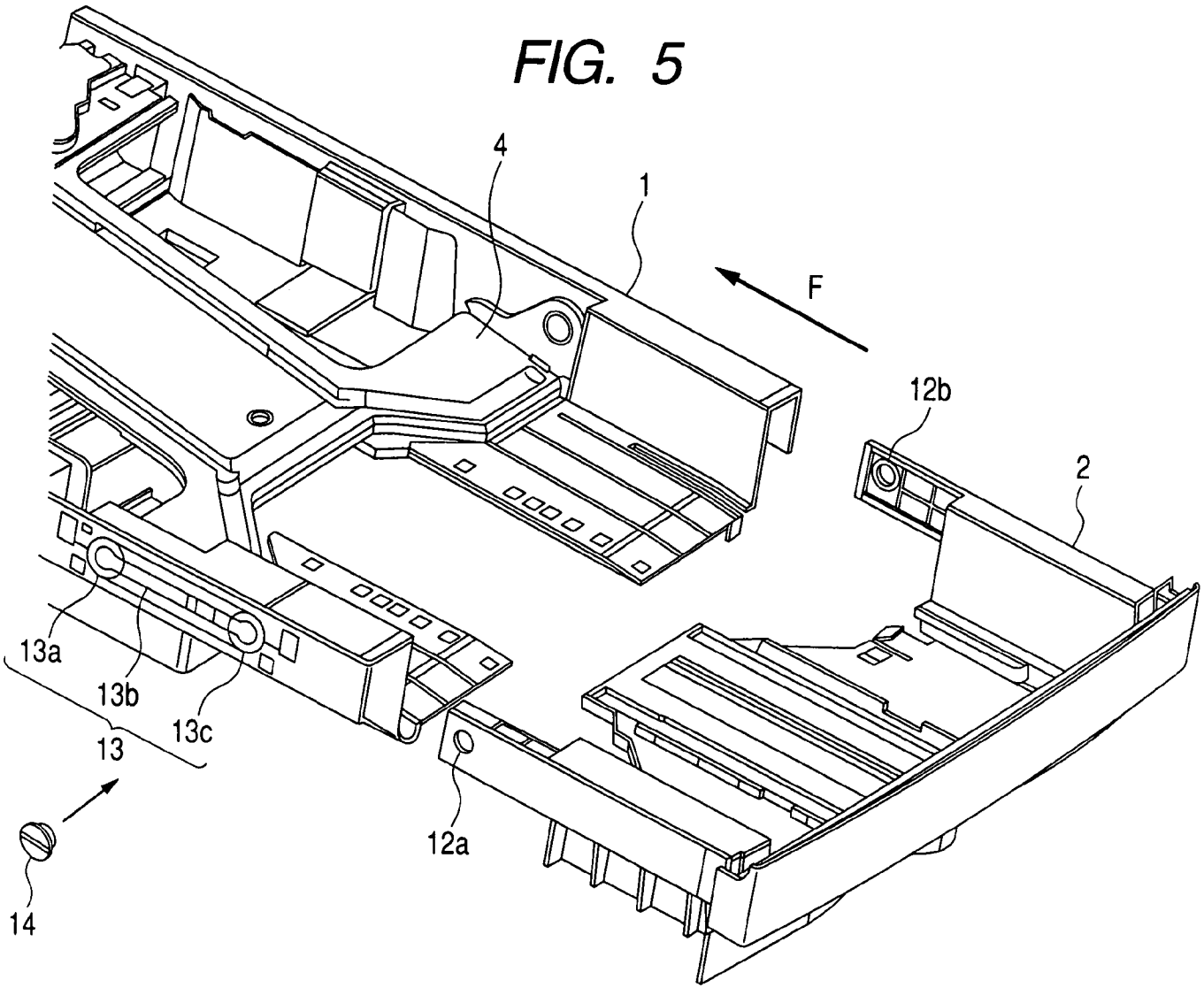
FIG. 5 is a perspective view of one sheet feed cassette according to one embodiment.

FIG. 5 is a perspective view of the sheet feed cassette 51 according to the embodiment, and shows a state before the sub container 2 is fitted into the main container 1.

The sub container 2 is inserted in the direction of an arrow F in the drawing, in the direction of sheet transport. The front edge 13*a* and the rear edge 13*c* of each long hole 13 disposed in the main container 1 are aligned with the holes 12*a* and 12*b* disposed in the sub container 2. Thus, locking members 14 are inserted from the left and right opposite outer sides of the sheet feed cassette 51. As a result, the main container 1 and the sub container 2 are connected to each other. For example, for from the postcard size (148 mm) to the A4 size (297 mm), the hole 12*a* of the sub container 2 is aligned with the front edge 13*a* of the long hole 13, and the locking member 14 is inserted thereinto. Thus, the sub container 2 is positioned. On the other hand, in the case of A4-sized or larger legal sheets (356 mm) or free size sheet, the following configuration is adopted. The hole 12*a* of the sub container 2 is aligned with the rear edge 13*c* of the long hole 13 of the main container 1, and the locking member 14 is set thereto. The function of the locking member 14 will be described later.

Then, the connection of the main container 1 and the sub container 2 and the locking mechanism in the embodiment will be described.

Figure 6:
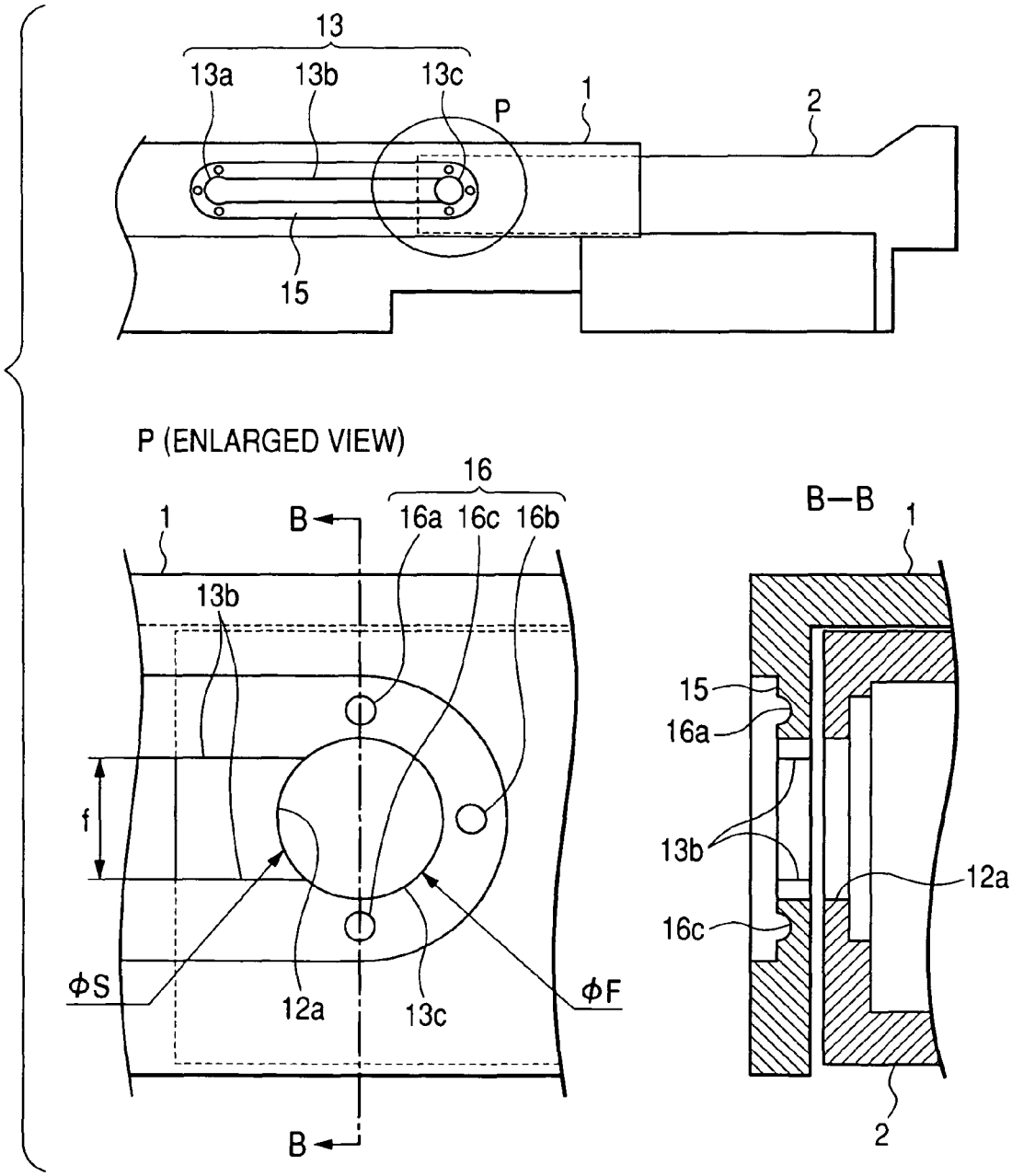
FIG. 6 is a partially enlarged view of the sheet feed cassette according to one embodiment.

FIG. 6 shows the connection part of the main container 1 and the sub container 2. First, the shape of the long hole 13 in the side surface of the main container 1 will be described.

In each long hole 13 disposed in the outer sides of the opposite side surfaces of the main container 1, as shown in the upper figure of FIG. 6, round shapes of the front edge 13*a* and the rear edge 13*c* are formed at the front and the rear in the direction of transport of sheets of the long hole 13. Further, the intermediate part 13*b* is formed of a straight line. The width dimension f of the intermediate part 13*b* is formed smaller than the diameter dimension ϕF of the front edge 13*a* and the rear edge 13*c*, and the diameter dimension ϕS of the holes 12*a* and 12*b* disposed in the opposite side surfaces of the sub container 2 as shown in the lower figure of FIG. 6 which is an enlarged view of the P part. As a result, each locking member 14 for positioning and locking the sub container 2 can be fixed on a position of 13*a* or 13*c* without falling. In addition, it is possible to move the sub container 2 together with each locking member 14 along the straight line of the intermediate part 13*b* when the position of the sub container 2 is changed.

In this embodiment, the ϕF is set at 8 mm; f, at 6 mm; and ϕS, 8 mm. Further, on the opposite side surfaces of the main container 1, long hole concave surfaces 15 are formed. Spherical concaves 16 (16*a*, 16*b*, and 16*c*) are disposed concentrically with the front edge 13*a* and the rear edge 13*c* of the long hole 13.

Then, the shape of the locking member 14 for positioning and locking the main container 1 and the sub container 2 will be described.

Figure 7:
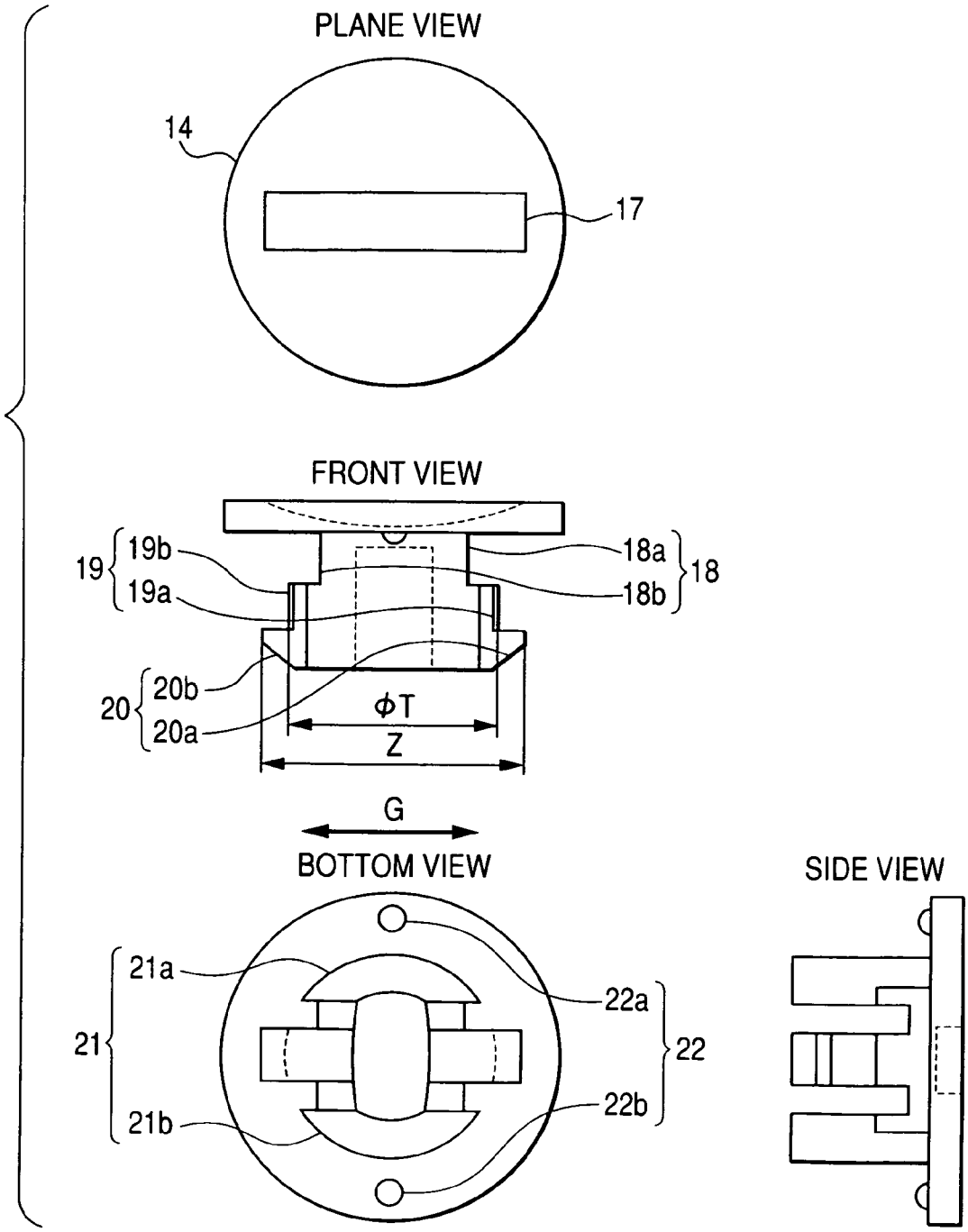
FIG. 7 is a detailed view of a locking member of the sheet feed cassette according to one embodiment.

FIG. 7 is a detailed view of the locking member 14 which is a constituent component of the locking mechanism of the sheet feed cassette 51 according to the embodiment. As shown in the front view and the bottom view of FIG. 7, the cylindrical part to be fitted into the long hole 13 of the main container 1 is formed of respective pairs of flat sides 18 (18*a* and 18*b*), circular arc sides 19 (19*a* and 19*b*), claw 20 (20*a* and 20*b*), and circular arc sides 21 (21*a* and 21*b*).

The circular arc sides 19 and 21 are the same circular arc. Further, the flat sides 18, the circular sides 19, and the claw 20 are elastically deformable in the direction of an arrow G in the drawing. Although the details of the reason will be described later, this is due to the following. The width Z of the claw 20 of the locking member 14 is larger than the diameter dimension ϕF of the front edge 13*a* and the rear edge 13*c* of the long hole 13 of the main container 1, and the diameter dimension ϕS of the hole 12*a* of the sub container 2 in FIG. 6. For this reason, the flat sides 18, the circular arcs 19, and the claw 20 are elastically deformed to be fitted into the long hole 13 of the main container 1.

In this embodiment, the width Z of the claw 20 of the locking member 14 is set at 10 mm. Further, the locking member 14 is formed of polyacetal, and the elastic deformation amount is set at 1 mm per side.

As shown in the front view of FIG. 7, on the top part of the locking member 14, there is a rectangular concave 17 in the form of a circular arc in cross section. Thus, it is configured such that a coin or the like is inserted into the concave 17 to rotate the locking member 14.

In the bottom surface opposite to the side including the concave 17 therein, there are semispherical convexes 22 (22*a*, 22*b*), which are configured to be fitted into the spherical concaves 16 disposed in the opposite sidewalls of the main container 1 shown in FIG. 6. This prevents the locking member 14 from rotating.

Then, the locking mechanism of the sheet feed cassette 51 according to the embodiment will be described by reference to FIGS. 8 and 9. First, cross sections C-C, D-D, and E-E are partial cross sections of the left-hand side of the main container 1, the sub container 2, and the locking member 14 being fitted to one another, and each show a state in which the sub container 2 is extracted and locked. At this step, the circular arc sides 21*a* and 21*b* of the locking member 14 shown in FIG. 7 are fitted into the rear edge 13*c* which is the circular arc side of the main container 1. As apparent also from the drawings, the width dimension f of the intermediate part 13*b* of the main container 1 is smaller than the diameter dimension ϕT of the circular arc sides 21*a* and 21*b* of the locking member 14. Therefore, the movement of the sub container 2 in the direction of an arrow L in the drawing (in the direction of shrinkage) is prevented.

The fitting parts H1 and H2 of the semispherical convexes 22 of the locking member 14 and the spherical concaves 16 of the main container 1, and further, the fitting parts 23*a* and 23*b* of the claw 20 of the locking member 14 and a concave part 58 of the sub container 2 suppress the rotary movement of the locking member 14. Therefore, the sub container 2 is locked in this state. In this embodiment, the ϕT is set at 7.8 mm.

Figure 8:
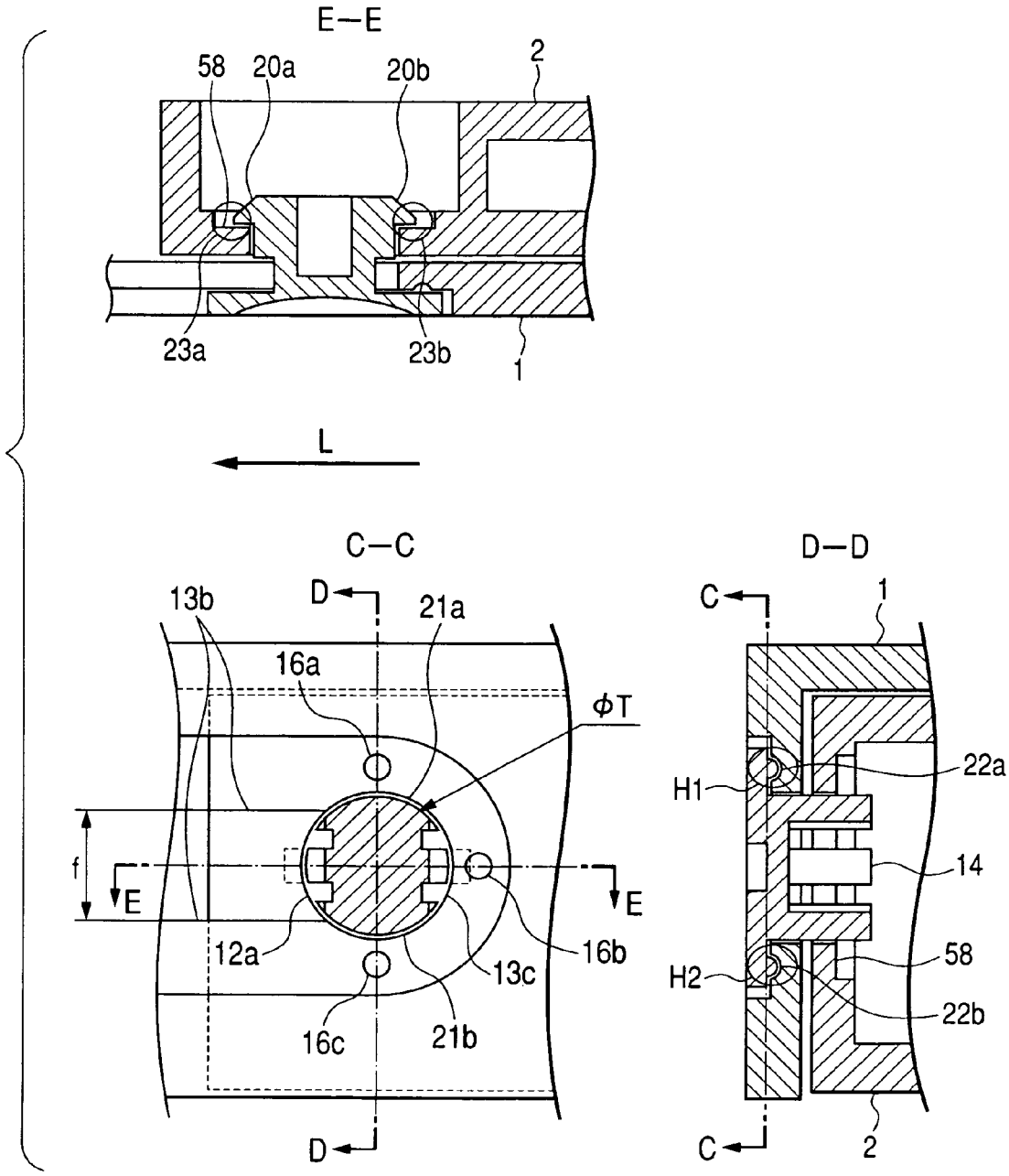
FIG. 8 is a fragmentary cross sectional view of the sheet feed cassette according to one embodiment.
Figure 9:
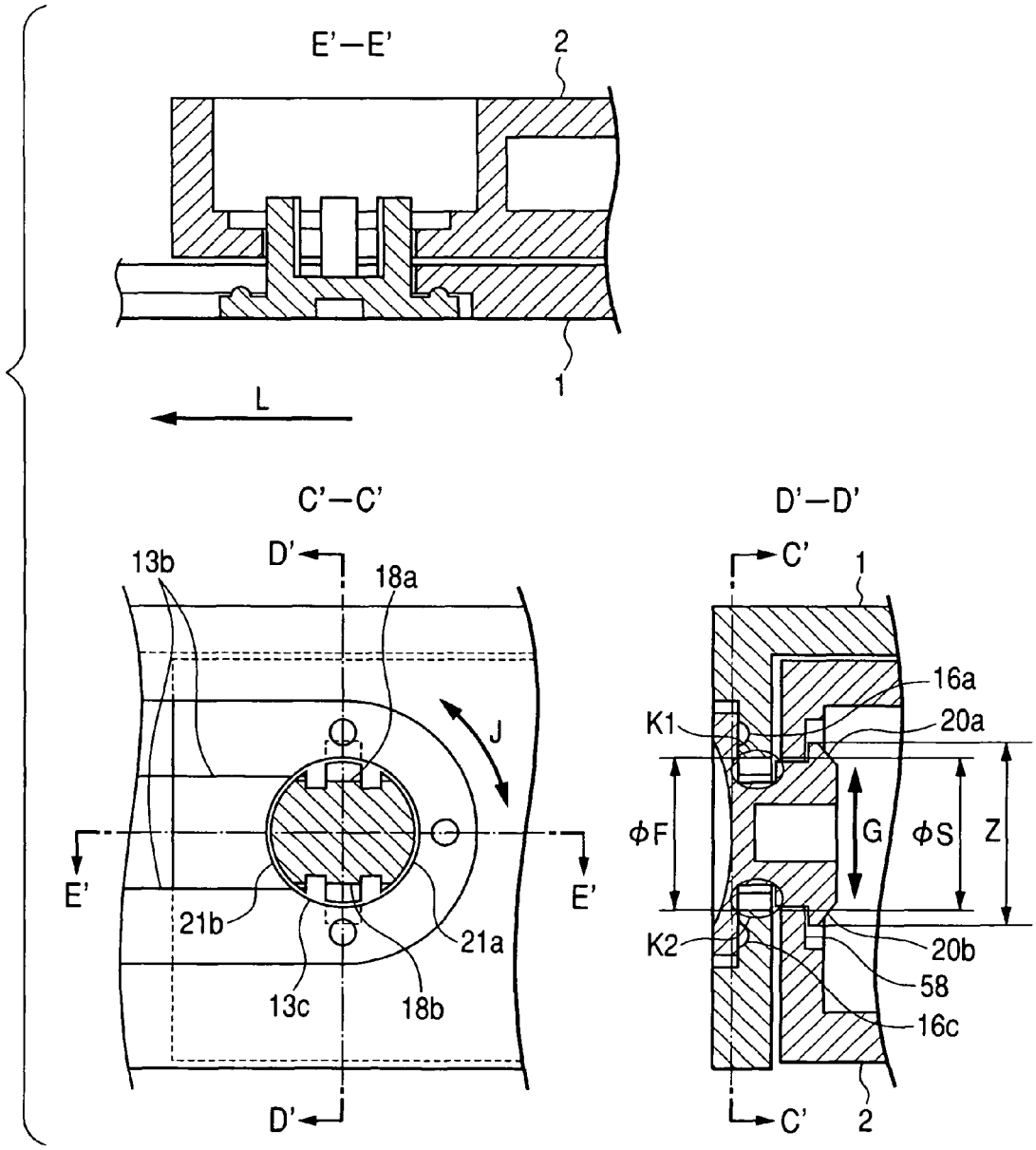
FIG. 9 is a fragmentary cross sectional view of the sheet feed cassette according to one embodiment.

FIG. 9 shows a state in which the locking member 14 has been rotated by 90° in the direction of an arrow J in the drawing from the locked state of FIG. 8 to release the lock. At this step, the flat sides 18*a* and 18*b* of the locking member 14 are in parallel with the linear surfaces of the intermediate part 13*b* of the long hole 13 of the main container 1. Accordingly, as shown in the cross section C'-C', the fit between the circular arc sides 21*a* and 21*b* of the locking member 14 and the rear edge 13*c* of the circular arc side of the main container 1 is released, so that spaces K1 and K2 are formed. For this reason, it becomes possible for the sub container 2 to move in the direction of an arrow L in the drawing.

The claw 20 disposed on the tip of the locking member 14 must have a width dimension Z larger than the diameter dimension ϕF of the rear edge 13*c* of the circular arc side of the main container 1, and the diameter dimension ϕS of the hole 12*a* of the sub container 2 while being mounted in the main container 1 and the sub container 2. This is for the following reason. When the width dimension Z is smaller than the diameter dimensions ϕF and ϕS, the locking member 14 slips and falls. Conversely, the locking member 14 can not be inserted unless the width dimension Z is smaller than the diameter dimensions ϕF and ϕS. For this reason, the claw 20 of the locking member 14 is configured to be elastically deformable in the direction of the arrow G in the drawing. Further, the claw 20 is elastically deformed only when the locking member 14 is inserted. When the locking member 14 is rotated to perform a locking/unlocking operation, the deformation of the claw 20 does not occur. For this reason, the locking member 14 is invariably fitted into the holes 12*a* and 12*b* of the sub container 2 in any state of locking/unlocking. In addition, the claw 20 (20*a*, 20*b*) disposed on the tip of the locking member 14 is fitted in the concave side 58 of the sub container 2. Therefore, the locking member 14 does not come off therefrom. As a result, the locking member 14 is not lost.

Then, by reference to FIGS. 10, 11, and 12, the sheet size detection mechanism of the sheet feed cassette according to the embodiment will be described. Also, FIGS. 2 and 3 show the states of the sheet feed cassette according to the embodiment with the sub container 2 extracted and retracted, respectively. Each is a bottom view as seen from the Y direction of FIG. 1, and hence reference should be made thereto.

Figure 10:
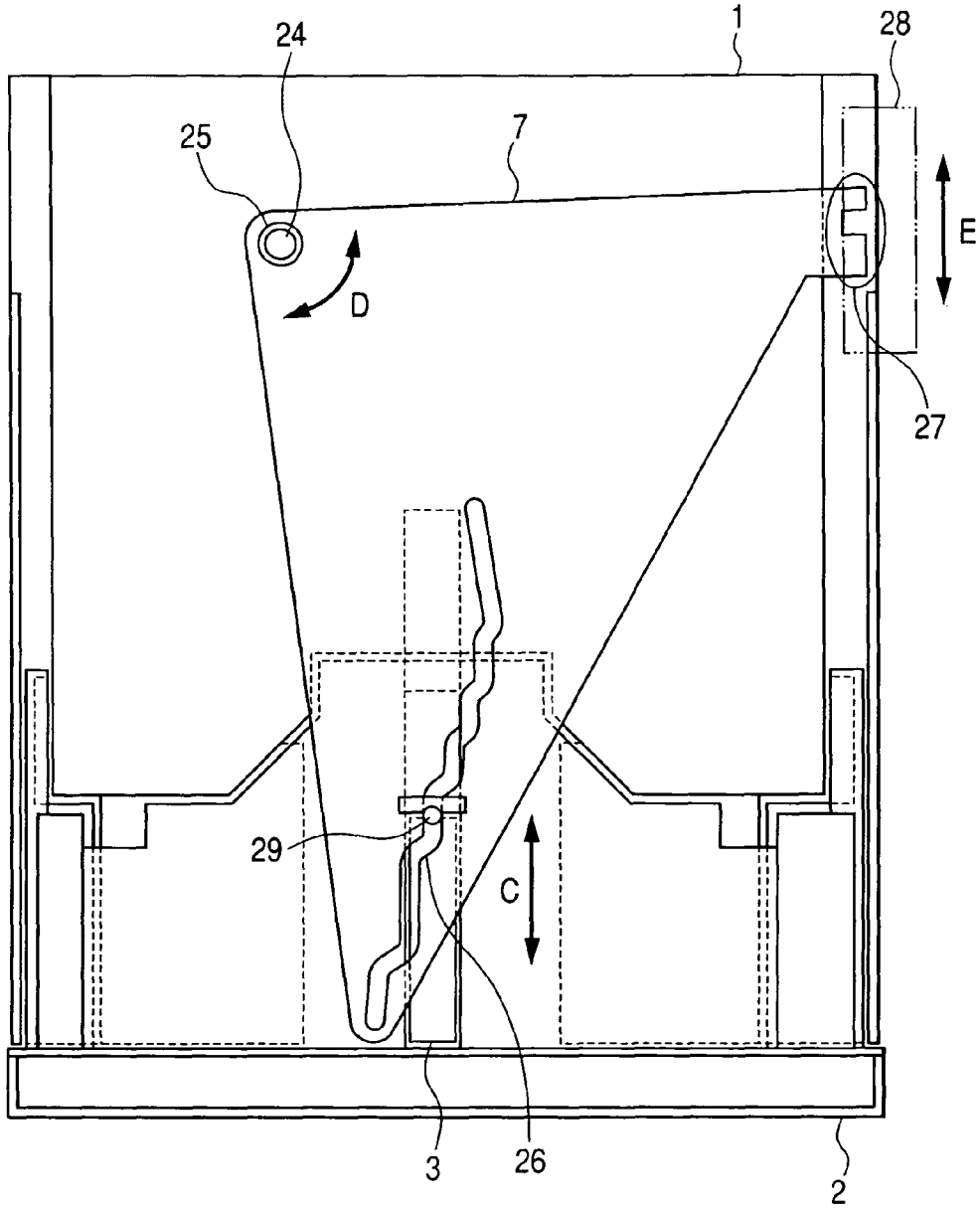
FIG. 10 is a bottom view of the sheet feed cassette according to one embodiment.

FIG. 10 is a bottom view of the sheet feed cassette according to the embodiment as seen from the direction of the bottom side (rear side), and shows a state in which the cassette is mounted in an image forming apparatus main body 37 not shown with the sub container 2 retracted First, the constitution will be described.

The sheet size detection unit 7 has a hole 25 for allowing rotary motion, and a zigzag continuous groove 26, and further, an uneven part 27 for detecting the rotary motion position.

The hole 25 is fitted in a shaft 24 disposed in the main container 1, and the continuous groove 26 is fitted in a pin 29 disposed at the sheet rear end guide 3.

Then, the motion will be described.

The pin 29 and the continuous groove 26 are invariably in contact with each other. Therefore, when the sheet rear end guide 3 is moved in the direction of the arrow C in the drawing, the sheet size detection unit 7 rotates in the direction of an arrow D in the drawing about the shaft 24 as the center. As a result, the uneven part 27 moves in the direction of an arrow E in the drawing. A sensor 28 set in the image forming apparatus main body 37 reads the displacement amount of the uneven part 27 at this step, and sends a signal of the sheet size to the image forming apparatus main body 37, resulting in a printable state.

Figure 11:
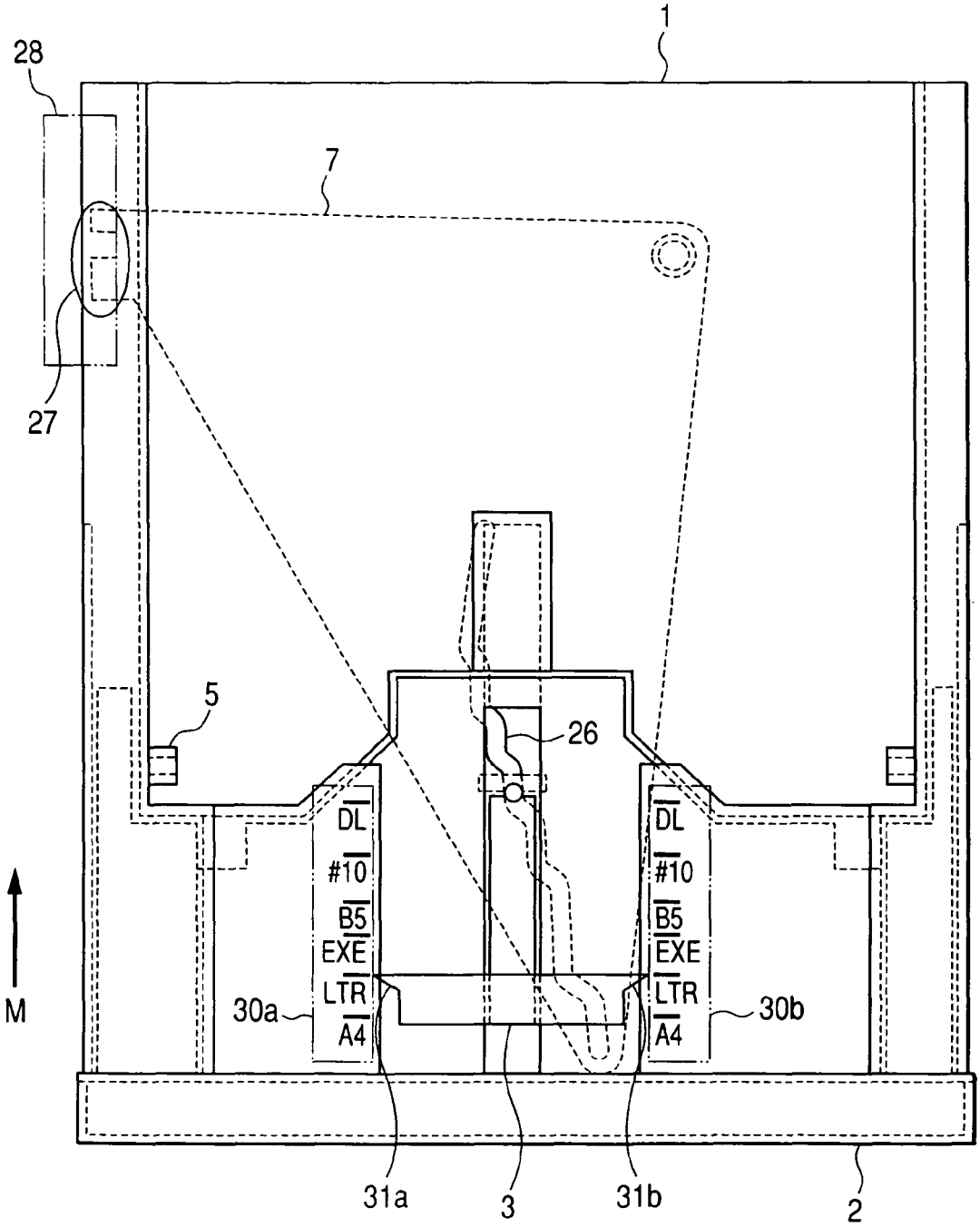
FIG. 11 is a plan view of the sheet feed cassette according to one embodiment.

FIG. 11 is a plan view of a state in which the sheet rear end guide 3 has been moved in the direction of an arrow M in the drawing from the state of FIG. 10, as seen from the opposite top side (sheet mounting side) from FIG. 10. The base plate 4 is omitted from the drawing.

On the opposite sides of the sheet rear end guide 3, projections 31*a* and 31*b* are disposed. Further, on the main container 1 and the sub container 2, various sheet sizes are displayed. Thus, when the sheet rear end guide 3 is moved according to the sheet size characters 30*a* and 30*b*, the sheet size detection unit 7 also moves in a coupled manner. This causes the uneven part 27 to rotate, so that the sensor 28 reads the displacement amount. Accordingly, the sheet size information is automatically transmitted to the image forming apparatus main body 37 side.

Figure 12:
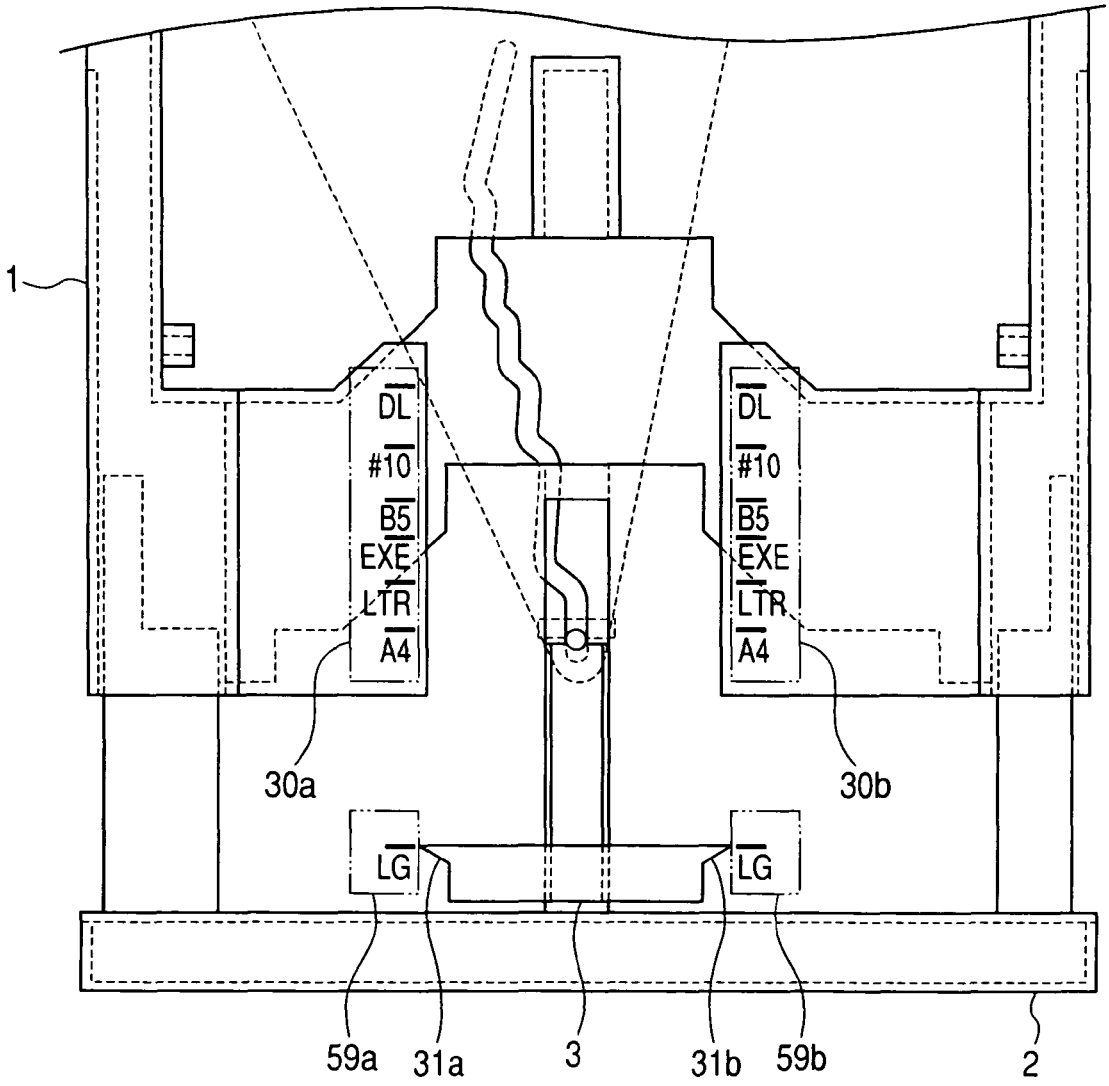
FIG. 12 is a plan view of the sheet feed cassette according to one embodiment.

FIG. 12 shows a state in which the sub container 2 has been extracted from the state of FIG. 11. Thus, it is configured as follows: when the sub container 2 is extracted, sheet size characters 59*a* and 59*b* for large size appear.

Figure 13:
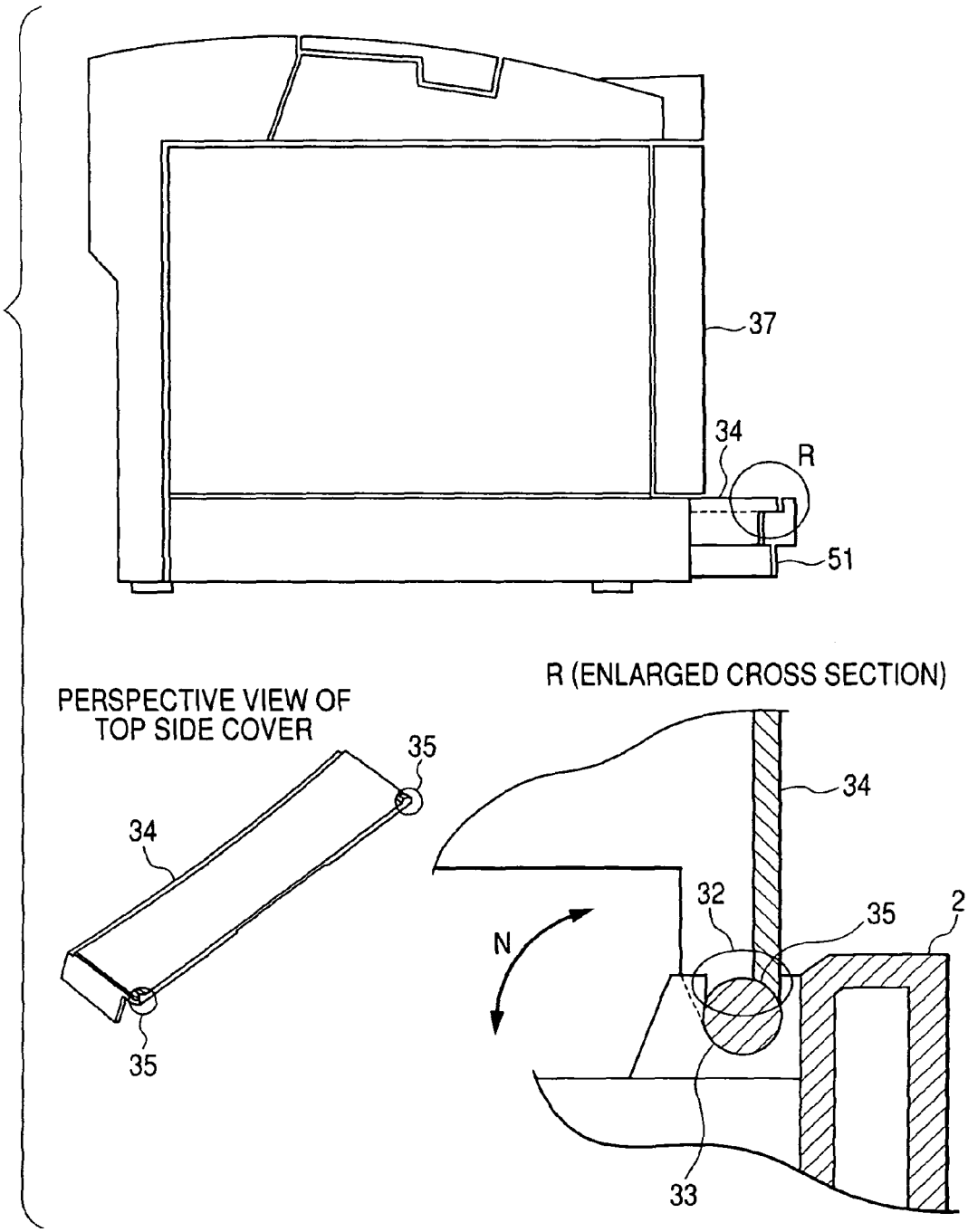
FIG. 13 is a side view of the sheet feed cassette according to one embodiment.

FIG. 13 shows a state in which the sheet feed cassette according to the embodiment has been mounted in the image forming apparatus 37, and a top side cover 34 has been attached to the sub container 2. When the sheet feed cassette 51 is used in an extracted form, the sub container 2 side juts out than the front side of the image forming apparatus 37. Accordingly, the top side of the sheets is exposed to the outside. Thus, conceivably, image defects and the like due to moisture absorption, and immersion of dust or the like occur. For this reason, the deficiencies are avoided by attaching the top side cover 34 thereto.

In the embodiment, in order for the top side cover to be attached and detached with ease, fitting holes 33 serving as the rotation axes of the top side cover 34 are disposed on the upper left and right opposite sides of the sub container 2. Further, a notch shape 32 is disposed in the upper part of each fitting hole 33. The notch shape 32 is not for a snap fit. In the case of a snap fit, when attachment and detachment are repeated, deformation or abrasion of the fitting part occurs. Therefore, it is not possible to invariably keep a constant operational feeling. For this reason, the notch shape 32 is designed so that attachment and detachment is possible only when the top side cover 34 rotates in the direction of an arrow N in the drawing to be vertical. This prevents the deformation or abrasion of the fitting part due to repetition of attachment and detachment, and invariably keeps a constant operational feeling, and also allows easy attachment and detachment. R (enlarged cross section) in the drawing shows a state in which the top side cover 34 has become vertical to be detachable.

In the embodiment, in the main container 1, the long holes 13 for carrying out extraction positioning of the sub container 2 are disposed. In the sub container 2, the holes 12 to be respectively fitted into the long holes 13 are disposed. As a result, it is possible to arbitrarily lock the extraction position of the sub container 2. Further, with the configuration described up to this point, it is possible to provide an easy-to-use extractable sheet feed cassette which can ensure the rigidity of the extractable sheet feed cassette and the reliability of the sheet size detection, and further, which can prevent the extraction and retraction of the sub container due to attachment and detachment of the sheet feed cassette, and can also ensure the attaching and detaching operability of the sheet feed cassette.

Further, the sheet feed cassette according to this embodiment has an inexpensive and hard configuration, and it is also advantageous in reduction of the size and the transport of an image forming apparatus.

According to an aspect of the present invention, it is possible to ensure the rigidity of the sheet feed cassette with a simple configuration.

The above-described embodiments of the present invention are merely possible examples of implementations, merely set forth for a clear understanding of the principles of the invention. In addition, many variations and modifications may be made to the above-described embodiments without departing substantially from the spirit and principles of the invention, of course.

What is claimed is:

1. A sheet feed cassette comprising:

a main container on which sheets are mounted;

a sub container slidably attached to the main container;

first slidable portions that are disposed on sidewalls of each of the main container and the sub container, and that are formed in a U-shape;

a rear end guide that is disposed on the sub container, that regulates a rear end of the sheets, and that is slidable in a direction of an extraction and a retraction of the sub container from the main container; and a size detector that is coupled with the rear end guide, and that detects a size of the sheets, the size detector comprising:

a hole for allowing a rotary motion;

a continuous groove formed in a zigzag;

a pin disposed on the rear end guide;

a sensor; and an uneven part for detecting a radial position of said size detector, wherein the hole mates with the main container, and wherein the pin is disposed in the continuous groove.

2. The sheet feed cassette according to claim 1 further comprising:

second slidable portions that are disposed on sheet mounting planes of the main container and the sub container, and that are formed in an L-shape.

3. The sheet feed cassette according to claim 1 further comprising:

a locking member that positions the sub container in a direction of an extraction and a retraction from the main container.

4. The sheet feed cassette according to claim 3, wherein the locking member is formed so as to be elastically deformable when attached into the main container.

5. The sheet feed cassette according to claim 1, further comprising:

a main container bottom cover that is disposed on a bottom of the main container beneath the size detector; and a sub container bottom cover that is disposed on a bottom of the sub container beneath the size detector, and that slides with the sub container, wherein the size detector is disposed on bottom rear portions of the main container and the sub container.

6. The sheet feed cassette according to claim 1, wherein the sub container includes a grip for extraction of the sheet feed cassette from an image forming apparatus.

7. The sheet feed cassette according to claim 1 further comprising:

a rotary axis that is disposed on left and right top sides of the sub container, and that rotatably supports a cover covering a top opening of the sub container.

8. An image forming apparatus comprising the sheet feed cassette according to claim 1.

9. The sheet feed cassette according to claim 1, wherein the first slidable portions are formed in an angular U-shape.

10. The sheet feed cassette according to claim 1, wherein the first slidable portions are disposed on upper portions of the sidewalls of the main container and the sub container.

11. A sheet feed cassette comprising:

a main container on which sheets are mounted:

a sub container slidably attached to the main container:

first slidable portions that are disposed on sidewalls of each of the main container and the sub container, and that are formed in a U-shape; and second slidable portions that are disposed on sheet mounting planes of the main container and the sub container, such that the second slidable portions of the main container comprise an S-shape or a reversed S-shape and the second slidable portions of the sub container comprise an L-shape.

12. The sheet feed cassette according to claim 1, wherein the first slidable portions are nested such that the slidable portions of the main container rest upon the slidable portions of the sub container.

13. The sheet feed cassette according to claim 3, wherein the locking member further comprises a peg which fits into one of a plurality of through holes located in the sidewalls of the main container and the sub container.

14. The sheet feed cassette according to claim 13, wherein the peg further comprises:

a head portion;

a shaft portion connected to said head portion; and a claw portion connected to said shaft portion, wherein said shaft portion has a portion of lower thickness along one plane perpendicular to an axis of said shaft, and wherein said claw portion is elastically deformable, such as to allow insertion into a hole with a diameter smaller than that of a diameter of said claw portion.

15. A sheet feed cassette comprising:

a main container on which sheets are mounted;

a sub container slidably attached to the main container;

first slidable portions that are disposed on sidewalls of each of the main container and the sub container, and that are formed in a U-shape; and a locking member that positions the sub container in a direction of an extraction and a retraction from the main container;

wherein the locking member further comprises a peg which fits into one of a plurality of through holes located in the sidewalls of the main container and the sub container, and wherein the through hole in the sidewall of the main container comprises a long slot, running along a length of the sidewall of the main container in an extension and a retraction direction, comprising rounded portions on an end of said through hole, a size of said rounded portions being greater than a size of an other portion of said through hole.

16. The sheet feed cassette according to claim 1, wherein the U-shape comprises three sides including an upper part in a direction horizontal to a sheet mounting side and two sides in a direction vertical to the sheet mounting side.

17. The sheet feed cassette according to claim 1, wherein the first slidable portions are disposed on upper portions of the sidewalls along a sliding direction of the main container and the sub container.

* * * * *